US009175541B2

(12) United States Patent
Jahnke

(10) Patent No.: US 9,175,541 B2
(45) Date of Patent: Nov. 3, 2015

(54) BLOWOUT PREVENTER SEAL ASSEMBLY AND METHOD OF USING SAME

(71) Applicant: National Oilwell Varco, L.P., Houston, TX (US)

(72) Inventor: Douglas A. Jahnke, Houston, TX (US)

(73) Assignee: National Oilwell Varco, L.P., Houston, TX (US)

( * ) Notice: Subject to any disclaimer, the term of this patent is extended or adjusted under 35 U.S.C. 154(b) by 220 days.

(21) Appl. No.: 13/860,342

(22) Filed: Apr. 10, 2013

(65) Prior Publication Data

US 2013/0264501 A1 Oct. 10, 2013

Related U.S. Application Data

(60) Provisional application No. 61/622,426, filed on Apr. 10, 2012.

(51) Int. Cl.
*E21B 33/06* (2006.01)

(52) U.S. Cl.
CPC ..... *E21B 33/06* (2013.01); *E21B 33/062* (2013.01)

(58) Field of Classification Search
USPC ..... 251/1.1, 1.2, 1.3
See application file for complete search history.

(56) References Cited

U.S. PATENT DOCUMENTS

| | | | |
|---|---|---|---|
| 1,454,187 | A | 5/1923 | Poppe et al. |
| 1,819,036 | A | 8/1931 | Oberhuber |
| 2,075,947 | A | 4/1937 | Kennedy |
| 2,178,698 | A | 11/1939 | Penick et al. |
| 2,898,000 | A | 8/1959 | Hanny |
| 2,980,284 | A | 4/1961 | Gill et al. |
| 3,001,803 | A | 9/1961 | Hill et al. |
| 3,028,917 | A | 4/1962 | Rhodes |
| 3,477,867 | A | 11/1969 | Hillier |
| 3,479,063 | A | 11/1969 | Raver |

(Continued)

FOREIGN PATENT DOCUMENTS

| | | |
|---|---|---|
| GB | 2340570 | 2/2000 |
| WO | 9318331 | 9/1993 |

(Continued)

OTHER PUBLICATIONS

International Search Report for PCT Patent Application No. PCT/US2013/035990 dated Jun. 4, 2014, 5 pages.

(Continued)

*Primary Examiner* — Marina Tietjen
*Assistant Examiner* — Daphne M Barry
(74) *Attorney, Agent, or Firm* — JL Salazar Law Firm

(57) ABSTRACT

A seal assembly for a blowout preventer of a wellsite is provided. The blowout preventer includes a housing and at least one component operatively connectable to the housing. The housing has a bore and a channel therethrough. A tubular is positionable through the bore and engageable therein. The seal assembly includes a seal plate, a seal carrier, and at least one seal. The seal plate is operatively connectable between the housing and the at least one component of the blowout preventer, and has at least one seal groove extending therein. The seal carrier is disposable about a perimeter of the seal plate, has at least one carrier lip disposable in a seal groove(s), and has at least one seal receptacle. The seal is receivably positionable in the seal receptacle, and in sealing engagement with one of the housing, the component, and combinations thereof.

25 Claims, 8 Drawing Sheets

(56) References Cited

U.S. PATENT DOCUMENTS

| | | | | |
|---|---|---|---|---|
| 3,653,673 | A | 4/1972 | Green | |
| 3,656,769 | A | 4/1972 | Jelinek et al. | |
| 3,820,830 | A | 6/1974 | Dryer | |
| 3,913,927 | A | 10/1975 | Gordon | |
| 4,131,287 | A | 12/1978 | Gunderson et al. | |
| 4,323,256 | A | 4/1982 | Miyagishima et al. | |
| 4,348,032 | A | 9/1982 | Hanson et al. | |
| 4,353,560 | A | 10/1982 | Tohill | |
| 4,369,977 | A | 1/1983 | Bishop et al. | |
| 4,477,093 | A | 10/1984 | Adamek | |
| 4,537,406 | A | 8/1985 | Hirasuna et al. | |
| 4,647,002 | A | 3/1987 | Crutchfield | |
| 4,655,284 | A | 4/1987 | McIlvride | |
| 4,703,938 | A | 11/1987 | Fox | |
| 4,997,193 | A | 3/1991 | Czernik | |
| 5,025,708 | A | 6/1991 | Smith et al. | |
| 5,064,164 | A | 11/1991 | Le | |
| 5,087,056 | A | 2/1992 | Baglin | |
| 5,431,417 | A | 7/1995 | Dahlgren | |
| 5,466,018 | A | 11/1995 | Stobbart | |
| 5,505,426 | A | 4/1996 | Whitby et al. | |
| 5,529,284 | A | 6/1996 | Berger et al. | |
| 5,575,452 | A | 11/1996 | Whitby et al. | |
| 5,588,491 | A | 12/1996 | Brugman et al. | |
| 5,655,745 | A * | 8/1997 | Morrill | 251/1.3 |
| 5,662,171 | A | 9/1997 | Brugman et al. | |
| 5,735,502 | A | 4/1998 | Levett et al. | |
| 5,778,918 | A | 7/1998 | McLelland | |
| 5,897,094 | A | 4/1999 | Brugman et al. | |
| 5,907,653 | A | 5/1999 | Burek et al. | |
| 5,975,484 | A | 11/1999 | Brugman et al. | |
| 6,070,912 | A | 6/2000 | Latham | |
| 6,173,770 | B1 | 1/2001 | Morrill | |
| 6,322,087 | B1 | 11/2001 | Swensen et al. | |
| 6,374,925 | B1 | 4/2002 | Elkins et al. | |
| 6,510,895 | B1 | 1/2003 | Koleilat et al. | |
| 6,612,584 | B1 | 9/2003 | Ferouz | |
| 6,857,634 | B2 | 2/2005 | Araujo | |
| 6,905,125 | B2 | 6/2005 | Shibata et al. | |
| 6,913,092 | B2 | 7/2005 | Bourgoyne et al. | |
| 6,926,283 | B2 | 8/2005 | Janoff et al. | |
| 7,044,430 | B2 | 5/2006 | Brugman et al. | |
| 7,051,989 | B2 | 5/2006 | Springett et al. | |
| 7,073,796 | B2 | 7/2006 | Tankioka et al. | |
| 7,096,960 | B2 * | 8/2006 | Hemphill et al. | 166/373 |
| 7,125,055 | B2 | 10/2006 | Dallas | |
| 7,140,618 | B2 | 11/2006 | Valls, Jr. | |
| 7,159,652 | B2 | 1/2007 | McGuire et al. | |
| 7,195,224 | B2 | 3/2007 | Le | |
| 7,216,872 | B1 | 5/2007 | Shaw et al. | |
| 7,234,530 | B2 | 6/2007 | Gass | |
| RE39,973 | E | 1/2008 | Spence et al. | |
| 7,350,562 | B2 | 4/2008 | McGuire et al. | |
| 7,357,187 | B2 | 4/2008 | Gass | |
| 7,367,396 | B2 | 5/2008 | Springett et al. | |
| 7,401,790 | B2 | 7/2008 | Sadowski | |
| 7,445,047 | B2 | 11/2008 | Gomez | |
| 7,448,454 | B2 | 11/2008 | Bourgoyne et al. | |
| 7,475,721 | B2 | 1/2009 | McGuire et al. | |
| 7,523,644 | B2 | 4/2009 | Van Winkle | |
| 7,798,466 | B2 | 9/2010 | Springett et al. | |
| 7,814,979 | B2 | 10/2010 | Springett et al. | |
| 7,967,299 | B2 | 6/2011 | McClanahan | |
| 8,096,585 | B2 | 1/2012 | Vitel et al. | |
| 2001/0045709 | A1 | 11/2001 | Stobbart | |
| 2004/0188949 | A1 | 9/2004 | Foote et al. | |
| 2004/0258470 | A1 | 12/2004 | Hemphill et al. | |
| 2005/0051362 | A1 | 3/2005 | McGuire et al. | |
| 2005/0082829 | A1 | 4/2005 | Dallas | |
| 2005/0242519 | A1 | 11/2005 | Koleilat et al. | |
| 2006/0076526 | A1 | 4/2006 | McWhorter et al. | |
| 2006/0243451 | A1 | 11/2006 | Hemphill et al. | |
| 2007/0051164 | A1 | 3/2007 | Van Winkle | |
| 2007/0089887 | A1 | 4/2007 | Gomez | |
| 2007/0102150 | A1 | 5/2007 | McGuire et al. | |
| 2008/0142210 | A1 | 6/2008 | McGuire et al. | |
| 2008/0265188 | A1 | 10/2008 | Springett et al. | |
| 2009/0033111 | A1 | 2/2009 | Hupp | |
| 2009/0056132 | A1 | 3/2009 | Foote | |
| 2009/0151959 | A1 | 6/2009 | Darnell et al. | |
| 2010/0243926 | A1 | 9/2010 | Weir | |
| 2010/0319906 | A1 | 12/2010 | Van Winkle | |
| 2011/0000670 | A1 | 1/2011 | Springett et al. | |
| 2011/0012311 | A1 | 1/2011 | McClanahan | |
| 2011/0226475 | A1 | 9/2011 | Springett et al. | |
| 2012/0012339 | A1 | 1/2012 | Weir et al. | |
| 2012/0012340 | A1 | 1/2012 | Ensley et al. | |
| 2012/0055677 | A1 | 3/2012 | Boyd | |
| 2012/0120192 | A1 | 5/2012 | Alregib et al. | |
| 2012/0120193 | A1 | 5/2012 | Shimizu | |
| 2012/0193874 | A1 | 8/2012 | Melancon et al. | |
| 2012/0227987 | A1 | 9/2012 | Catriotta et al. | |
| 2013/0018217 | A1 | 1/2013 | Santek et al. | |
| 2013/0264501 | A1 | 10/2013 | Jahnke | |
| 2014/0062038 | A1 | 3/2014 | Wolf et al. | |

FOREIGN PATENT DOCUMENTS

| | | |
|---|---|---|
| WO | 2012012192 | 1/2012 |
| WO | 2012012193 | 1/2012 |
| WO | 2012106061 | 8/2012 |
| WO | 2013002971 | 1/2013 |

OTHER PUBLICATIONS

International Search Report for counterpart Application PCT/US2012/020405 dated Oct. 17, 2012, 5 pages.

International Preliminary Report on Patentability and Written Opinion for PCT/US2013/035990 dated Oct. 14, 2014, 7 pages.

International Preliminary Report on Patentability and Written Opinion for PCT/US2012/020105 dated Jul. 13, 2013, 6 pages.

International Preliminary Report on Patentability and Written Opinion for PCT/US2012/020405 dated Aug. 6, 2013, 7 pages.

Examination Report for Canadian Patent Application No. 2,825,374 dated Aug. 14, 2014, 2 pages.

* cited by examiner

FIG.5A
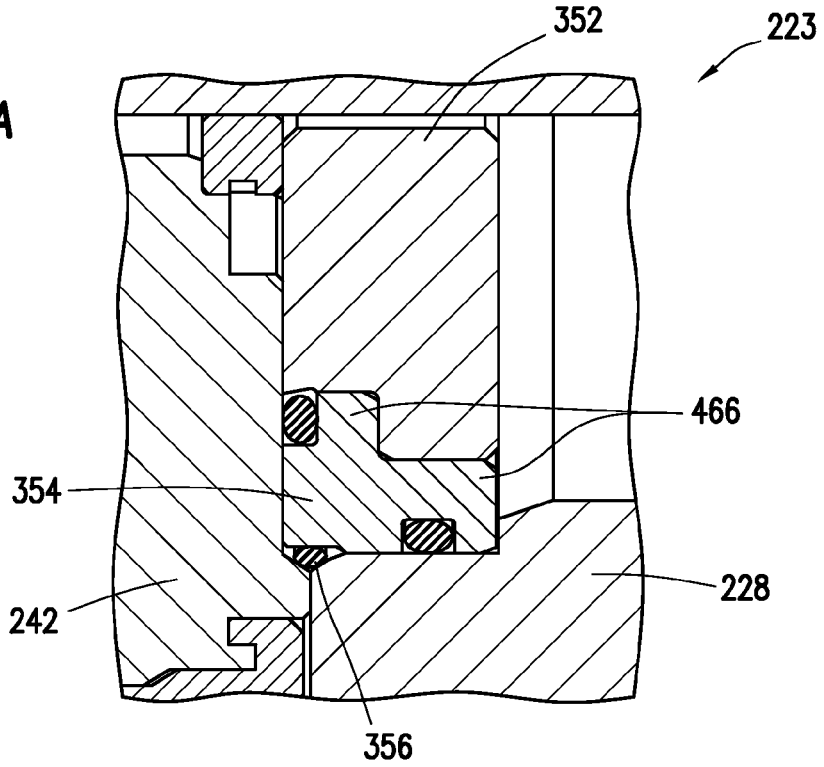
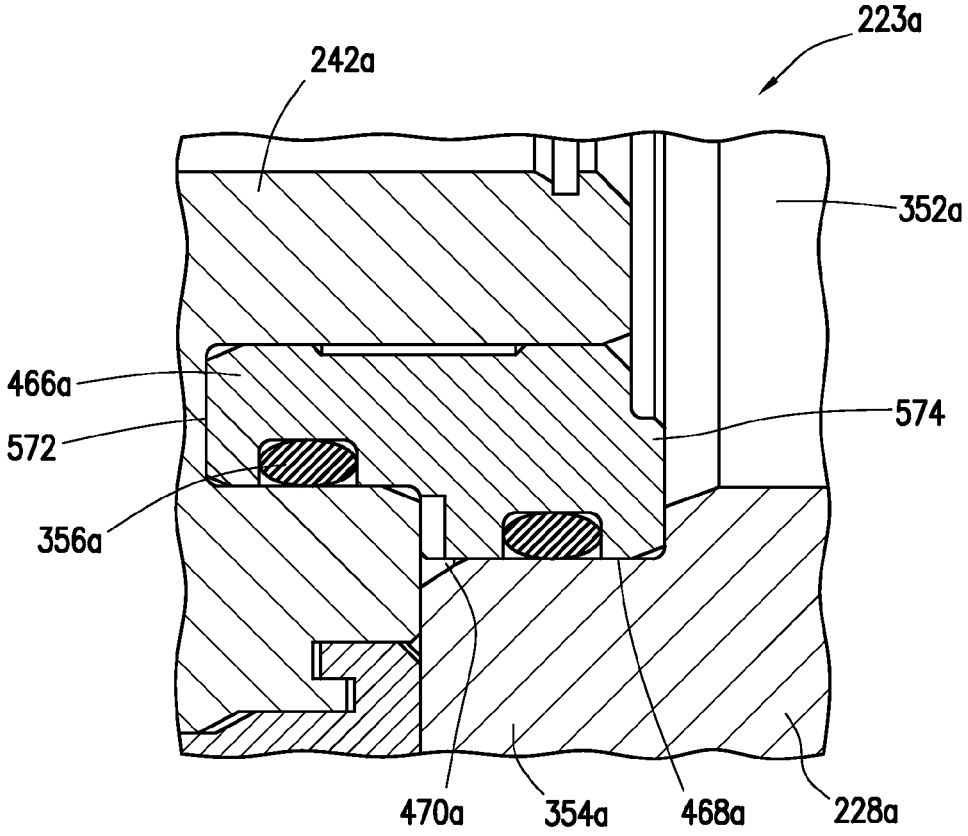
FIG.5B

FIG.5C
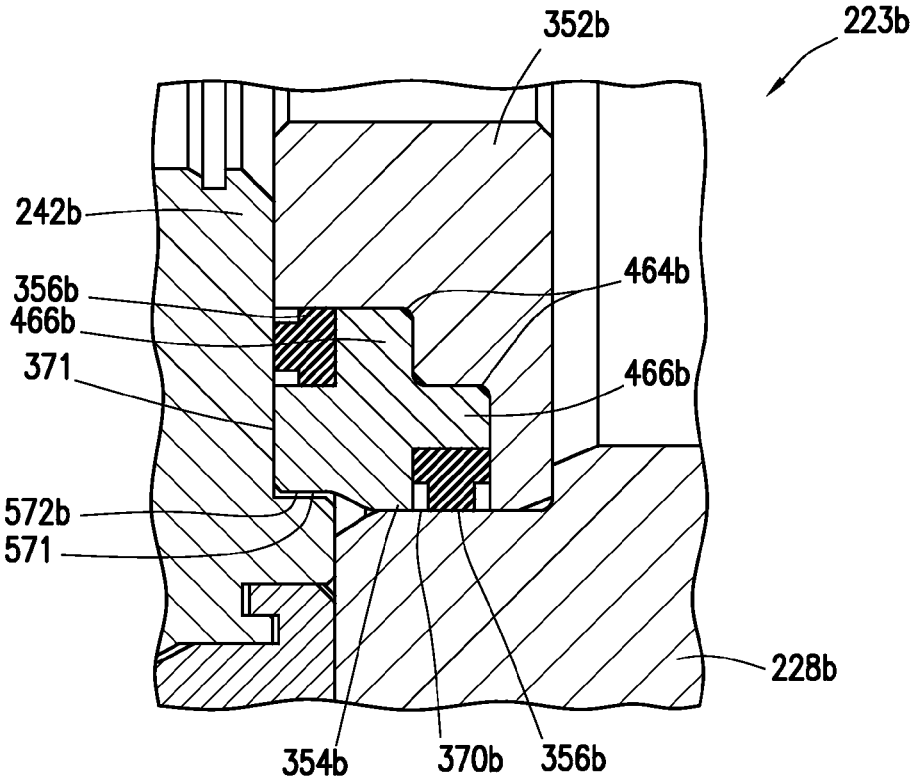
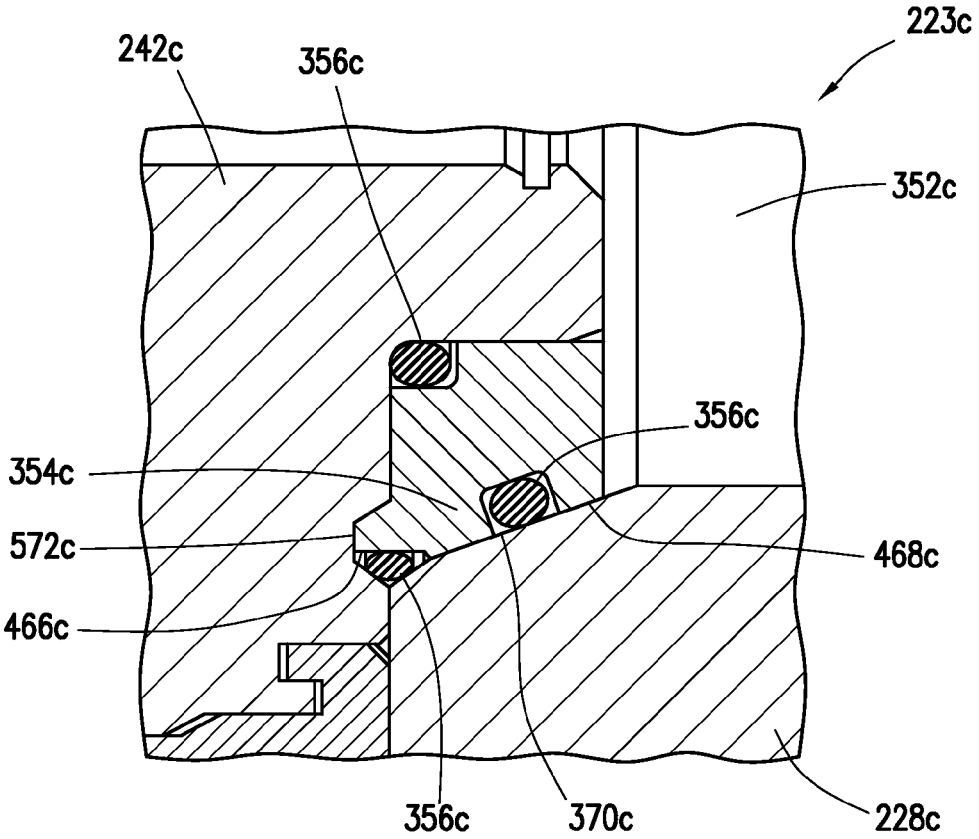
FIG.5D

BLOWOUT PREVENTER SEAL ASSEMBLY AND METHOD OF USING SAME

BACKGROUND

This present disclosure relates generally to techniques for performing wellsite operations. More specifically, the present disclosure relates to techniques for preventing blowouts involving, for example, a blowout preventer and/or a seal assembly.

Oilfield operations may be performed to locate and gather valuable downhole fluids. Oil rigs are positioned at wellsites, and downhole tools, such as drilling tools, are deployed into the ground to reach subsurface reservoirs. Once the downhole tools form a wellbore to reach a desired reservoir, casings may be cemented into place within the wellbore, and the wellbore completed to initiate production of fluids from the reservoir. Downhole tubular devices may be positioned in the wellbore to enable the passage of subsurface fluids to the surface.

Leakage of subsurface fluids may pose an environmental threat if released from the wellbore. Equipment, such as blow out preventers (BOPs), may be positioned about the wellbore to form a seal about a tubular therein to prevent leakage of fluid as it is brought to the surface. BOPs may have selectively actuatable rams or ram bonnets, such as pipe rams or shear rams, that may be activated to seal and/or sever a tubular in a wellbore. Some examples of BOPs are provided in U.S. Patent/Application No. 20110000670; U.S. Pat. Nos. 7,814,979; and 7,367,396.

It may be desirable to provide BOPs with various features, such as seals, ram blocks, doors and/or lock mechanisms, etc., for use in wellsite operations. Examples of BOPs and/or features may be provided in U.S. patent application Ser. No. 13/018,217 (not yet published at the time of filing), US2010/0243926, US2011/0012311, U.S. Pat. No. 5,897,094, U.S. Pat. No. 7,044,430, U.S. Pat. No. 7,051,989, U.S. Pat. No. 5,575,452, WO 2012/012192, WO 2012/012193, U.S. Pat. No. 7,195,224 and U.S. Pat. No. 7,798,466.

SUMMARY

In at least one aspect, the disclosure relates to a seal assembly for a blowout preventer of a wellsite. The blowout preventer includes a housing and at least one component operatively connectable to the housing. The housing has a bore and a channel therethrough, and a tubular positionable through the bore and engagable therein. The seal assembly includes a seal plate, a seal carrier and at least one seal. The seal plate is operatively connectable between the housing and the at least one component of the blowout preventer, the seal plate having at least one seal groove extending therein, the seal carrier being disposable about a perimeter of the seal plate. The seal carrier has at least one carrier lip disposable in the at least one seal groove, and also has at least one seal receptacle. The seal is receivably positionable in the at least one seal receptacle, and is positionable in sealing engagement with one of the housing and/or the component.

The component includes a door operatively connectable to the housing and providing selective access to the channel. The seal plate has an elliptical body with flat surfaces positionable adjacent the housing and the at least one component. The seal plate has at least one hole therethrough to receive at least one portion of the at least one component. The seal assembly also includes fasteners to operatively connect the seal plate to at least one of the component, the housing and combinations thereof. The seal plate has steps along a portion perimeter thereof, and the seal carrier has corresponding lips positionable receivable in the steps and adjacent the housing and/or the component. At least one of the housing and the component has at least one housing receptacle therein, and at least one of the carrier lips is positionable in the receptacle. The seal carrier and the seal include a rubber material and/or a metal material. The seal plate includes a metal material.

In another aspect, the disclosure relates to a blowout preventer for a wellsite having a tubular extending into a wellbore. The blowout preventer includes a housing, at least one component operatively connectable to the housing, and at least one seal assembly. The housing has a bore and a channel therethrough, and a tubular positionable through the bore and engageable therein. The seal assembly includes a seal plate, a seal carrier and at least one seal. The seal plate is operatively connectable between the housing and the at least one component of the blowout preventer. The seal plate has at least one seal groove extending therein, and the seal carrier is disposable about a perimeter of the seal plate. The seal carrier has at least one carrier lip disposable in the at least one seal groove, and has at least one seal receptacle. The seal is receivably positionable in the at least one seal receptacle, and is positionable in sealing engagement with one of the housing and/or the component.

The component may include a door operatively connectable to the housing and providing selective access to the channel. The seal plate is operatively connectable between the housing and the door, and the seal is positionable in sealing engagement with the housing and the component. The component may include a ram assembly slidably positionable in the channel to sever the tubular. The component may include a door assembly operatively connectable to the housing and providing selective access to the channel. The door assembly may be receiveably connectable to the ram assembly. The holes of the seal plate receive a portion of the ram assembly therethrough. The housing has a housing receptacle shaped to receive the seal carrier. The component may have a component receptacle shaped to receive the seal assembly. The blowout preventer may also include an actuator operatively connectable to the ram assembly for actuation thereof.

In yet another aspect, the disclosure relates to a method of sealing a blowout preventer of a wellsite. The blowout preventer includes a housing and at least one component operatively connectable to the housing. The housing has a bore and a channel therethrough. A tubular is positionable through the bore and engageable therein. The method involves operatively connecting a seal plate between the housing and the at least one component of the blowout preventer (the seal plate having at least one seal groove extending therein), disposing a seal carrier about a perimeter of the seal plate (the seal carrier having at least one carrier lip disposable in the at least one seal groove, and at least one seal receptacle), and positioning the at least one seal in the at least one seal receptacle and in sealing engagement with one of the housing, the component and combinations thereof.

The disclosure may also relate to a blowout preventer for sealing about a tubular including a housing, a door assembly and a seal assembly. The housing has a bore and a channel therethrough. The tubular is positionable through the bore. The door assembly is positionable about an opening of the housing and providing selective access to the channel therein. The seal assembly is operatively connectable to the door assembly and positionable in sealing engagement with the housing whereby the channel is sealed.

The disclosure may also relate to a method of sealing a tubular. The method involves positioning a blowout preventer about a wellbore, positioning a tubular through the bore of the housing, and sealing the channel by positioning the seal assembly in the channel in sealing engagement with the door assembly and the housing.

BRIEF DESCRIPTION OF THE DRAWINGS

So that the above recited features and advantages of the present disclosure can be understood in detail, a more particular description of the disclosure, briefly summarized above, may be had by reference to the embodiments thereof that are illustrated in the appended drawings. It is to be noted, however, that the appended drawings illustrate only typical embodiments and are, therefore, not to be considered limiting of its scope. The figures are not necessarily to scale and certain features, and certain views of the figures may be shown exaggerated in scale or in schematic in the interest of clarity and conciseness.

FIGS. 5A-5D depict vertical cross-sectional views of a portion of various BOPs with various seal configurations.

DETAILED DESCRIPTION

The description that follows includes exemplary apparatus, methods, techniques, and/or instruction sequences that embody techniques of the present subject matter. However, it is understood that the described embodiments may be practiced without these specific details.

Blowout preventers (BOPs) may be positioned about a tubular to provide a seal therewith, for example, during a blowout. To access portions of the BOP and/or components therein, the BOP may be provided with a door assembly to provide selective access thereto. To prevent leakage, for example during high pressures and temperatures, a seal assembly may be provided between the housing and the door assembly. The seal assembly may be self-aligning with the BOP housing.

Figure 1:
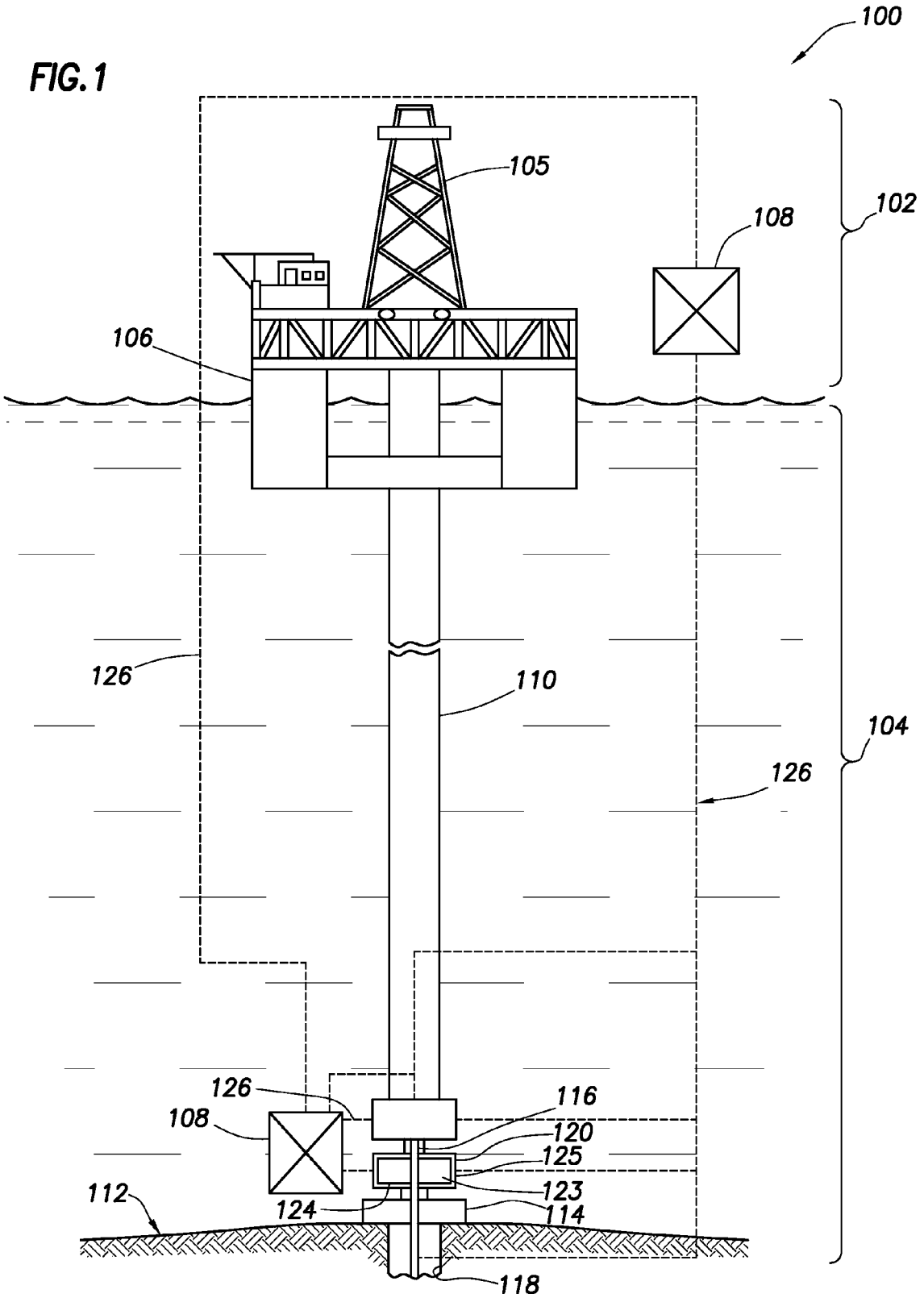
FIG. 1 depicts a schematic view of an offshore wellsite having a blowout preventer (BOP) with a ram assembly, a door assembly, and a seal assembly.

FIG. 1 depicts an offshore wellsite 100 having a subsea system 104 and a surface system 102. The surface system 102 may be used to facilitate the oilfield operations at the offshore wellsite 100. The surface system 102 may include a rig 105, a platform 106 (or vessel) and a controller 108.

The subsea system 104 includes a conduit (e.g., riser) 110 extending from the platform 106 to a sea floor 112. The subsea system further includes a wellhead 114 with a tubular 116 extending into a wellbore 118, a BOP 120 and a controller 108. The BOP 120 has various BOP components, such as a ram assembly 124 for shearing the tubular 116 and sealing the wellbore 118. The ram assembly 124 is engageable with the tubular 116 to form a seal about the tubular and/or to sever or cut the tubular 116. The BOP 120 also has a door assembly 125 for providing selective access into the BOP and a seal assembly 123 for sealing the BOP 120 as will be described more fully herein. The seal assembly 123 may be used for sealing the housing, door assembly 125 and/or other components of the BOP 120.

The surface system 102 and subsea system 104 may be provided with one or more controllers 108 located at various locations to control the surface system 102 and/or the subsea system 104. Communication links 126 may be provided for communication between the controllers 108 and various parts of the wellsite 100.

Although the BOP 120 is described herein as being used in subsea operations, it will be appreciated that the wellsite 100 may be land or water based, and the BOP 120 and/or shear sealing system 124 may be used in any wellsite environment. The BOP 120 may sever and/or seal a tubular device, such as tubular 116. 'Tubular devices' as used herein refers to tubular members or devices, such as pipes, certain downhole tools, casings, drill pipe, liner, coiled tubing, production tubing, wireline, slickline, or other tubular members positioned in the wellbore, and associated components, such as drill collars, tool joints, drill bits, logging tools, packers, and the like, (referred to as 'tubulars' or 'tubular strings').

Figure 2A:
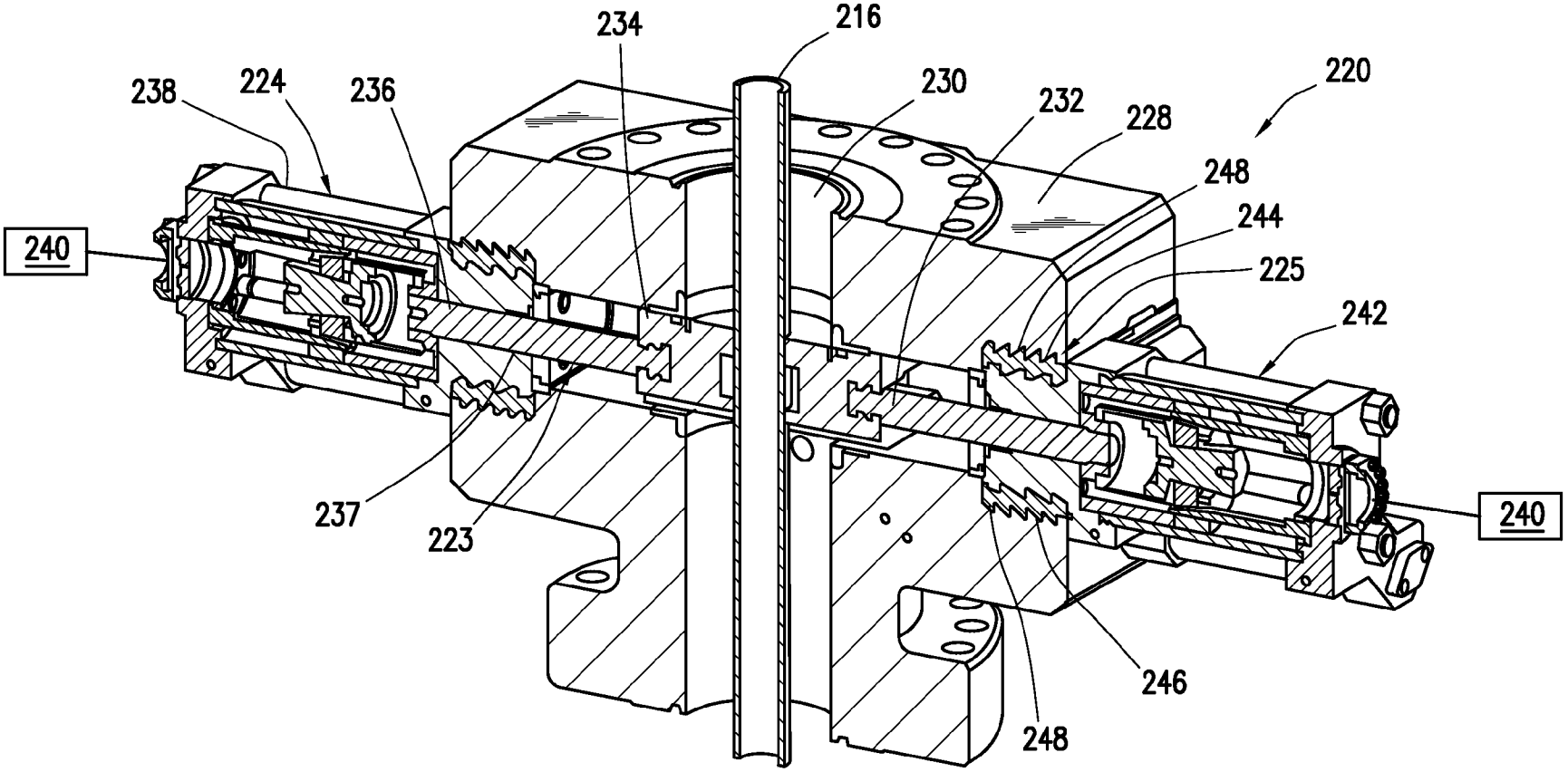
FIGS. 2A-2B depict vertical cross-sectional views of a BOP with a ram assembly in a sealed and an unsealed position, respectively.
Figure 2B:
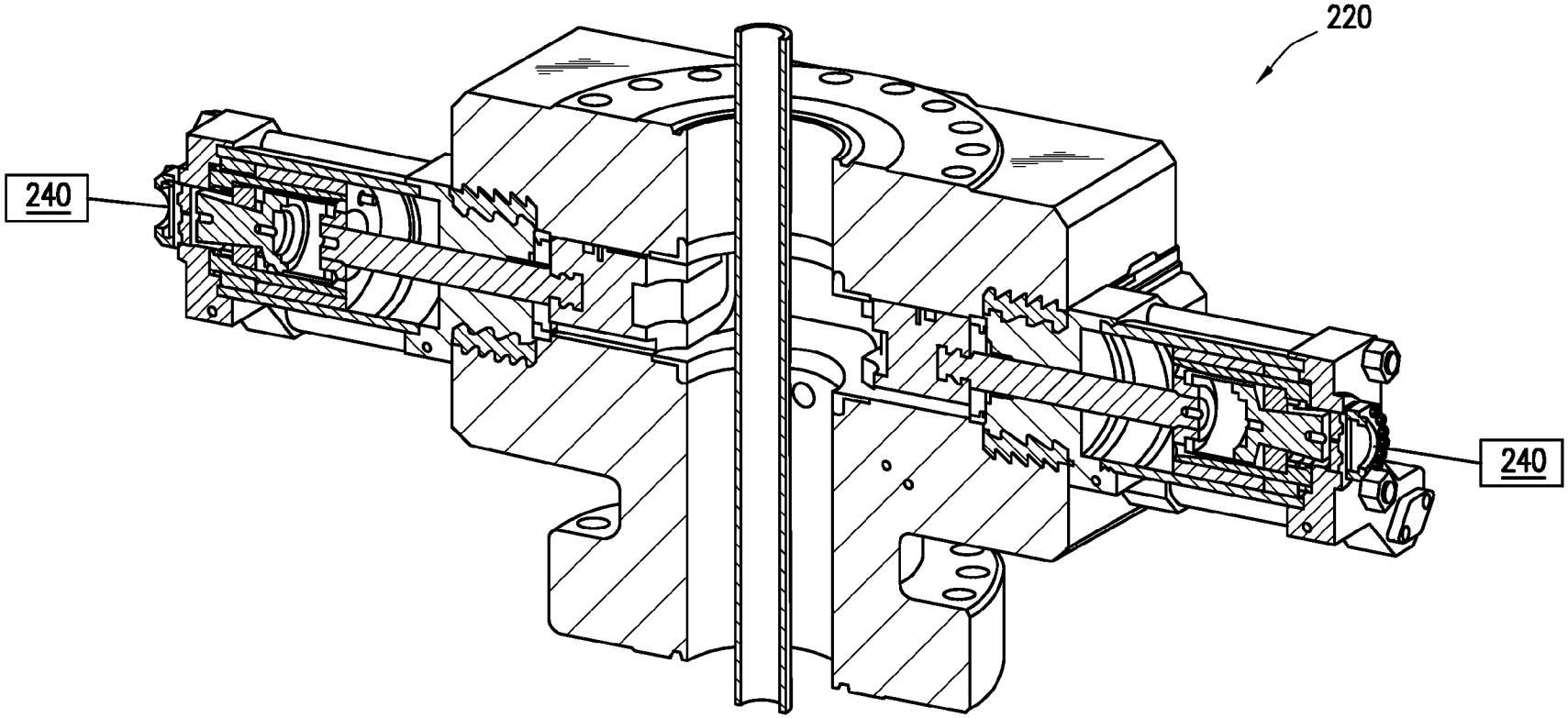

FIGS. 2A and 2B depict longitudinal cross-sectional views of a BOP 220 in a sealed and an unsealed position, respectively. The BOP 220 includes a housing 228 with a bore 230 and a channel 232 therethrough. The BOP also includes a ram assembly 224 and a door assembly 225. The ram assembly 224 includes a ram block 234, a ram shaft 236, a ram cylinder 238 and an actuator 240. The ram shaft 236 extends through a ram channel 237. The BOP 220 of FIGS. 2A and 2B is depicted with two opposing ram assemblies 224, but any number may be provided in any direction. The ram block 234 may seal with and/or sever a tubular 216. An example of a ram assembly usable with the BOP is described in U.S. Pat. No. 5,735,502.

The door assembly 225 includes a door 242 that provides access to the channel 232 and components of the BOP 220. The ram shaft 236 extends through the door 242 and to the ram cylinder 238 external thereto. The door assembly 225 is also provided with a lock 244 with teeth 246 for locking engagement with the housing 228. The lock 244 as shown includes a pair of locking plates 248 positioned between the door 242 and the housing 228 for interlocking engagement therewith. The lock 244 may optionally be integral with the door 242 or housing 228.

The seal assembly 223 is positioned in the channel 232 adjacent door 242. The seal assembly 223 provides a seal about the door 242 and the BOP housing 228. As shown, the seal assembly 223 is positioned on an interior surface of the door 242 for sealing the channel 232.

The seal assembly 223 is depicted as being positioned in a BOP between the BOP housing 228 and door assembly 225, but could be at other locations that are configured to receive the seal assembly 223.

Figure 3:
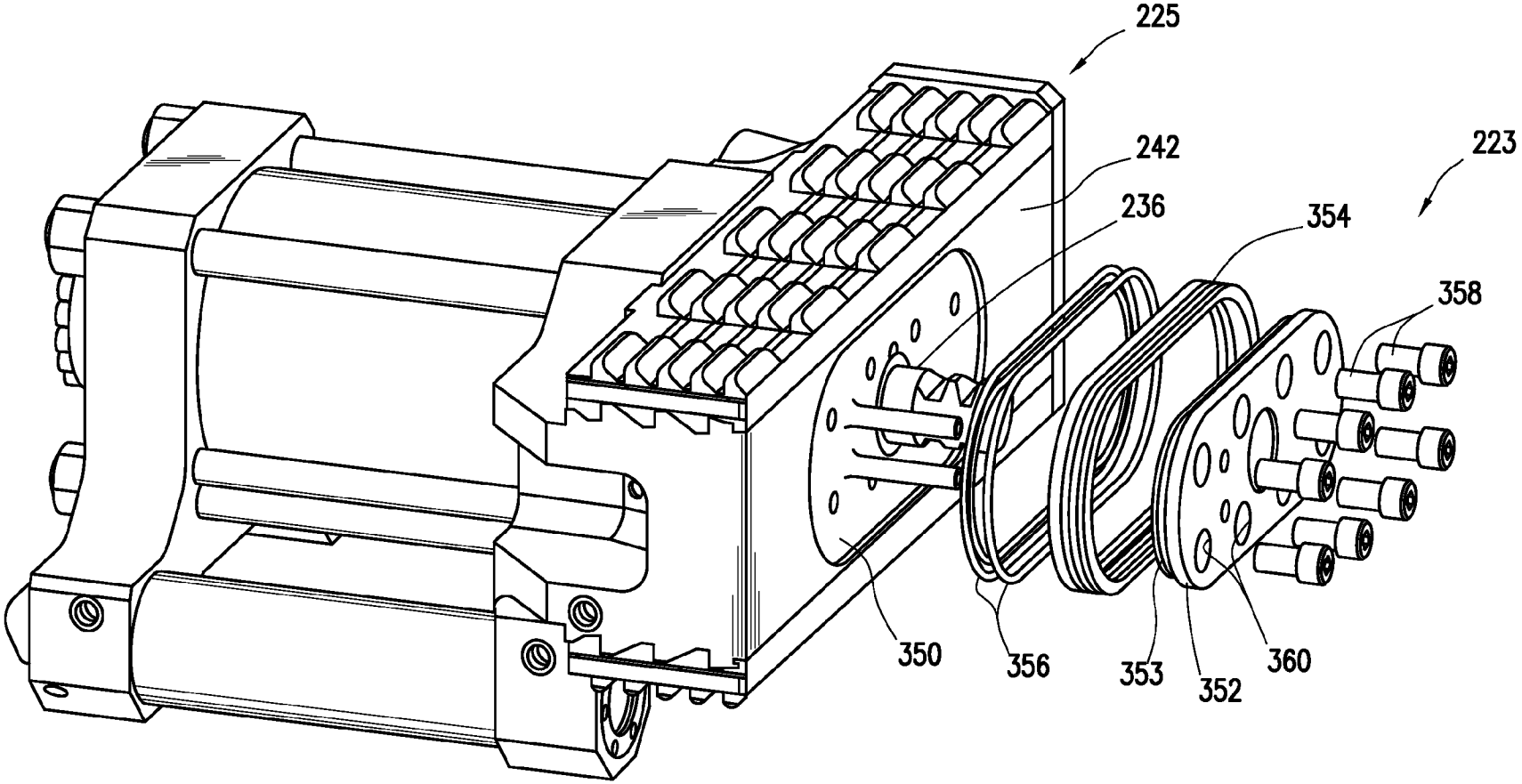
FIG. 3 depicts an exploded view of a seal assembly and a door assembly of a BOP.

FIG. 3 shows a perspective view of the door assembly 225 and an exploded view of the seal assembly 223. The seal assembly 223 includes a seal plate 352, a seal carrier 354, seals 356 and fasteners 358. The seal plate 352 is depicted as an oval plate having apertures 360 therethrough for receiving the fasteners 358, and has a seal ledge 353 for receiving the seal carrier 354. While the seal plate 352 is depicted as oval, it may be any shape that provides a seal between the BOP housing 228 and the door assembly 225 (see, e.g., FIGS. 2A and 2B).

Referring back to FIG. 3, the fasteners 358 extend through the seal plate 352 and into the door 242 for securing the seal plate 352 thereto. The door 242 is provided with a recess 350 for receiving the seal assembly 223. One of the apertures 360 may be shaped to receive the ram shaft 236 (and other components) therethrough. The seal carrier 354 has a racetrack configuration disposable about a perimeter of the seal plate 352. Seals 356 may be provided about the seal carrier 354. The seals 356 may have indentations for receiving the seals 356.

Figure 4A:
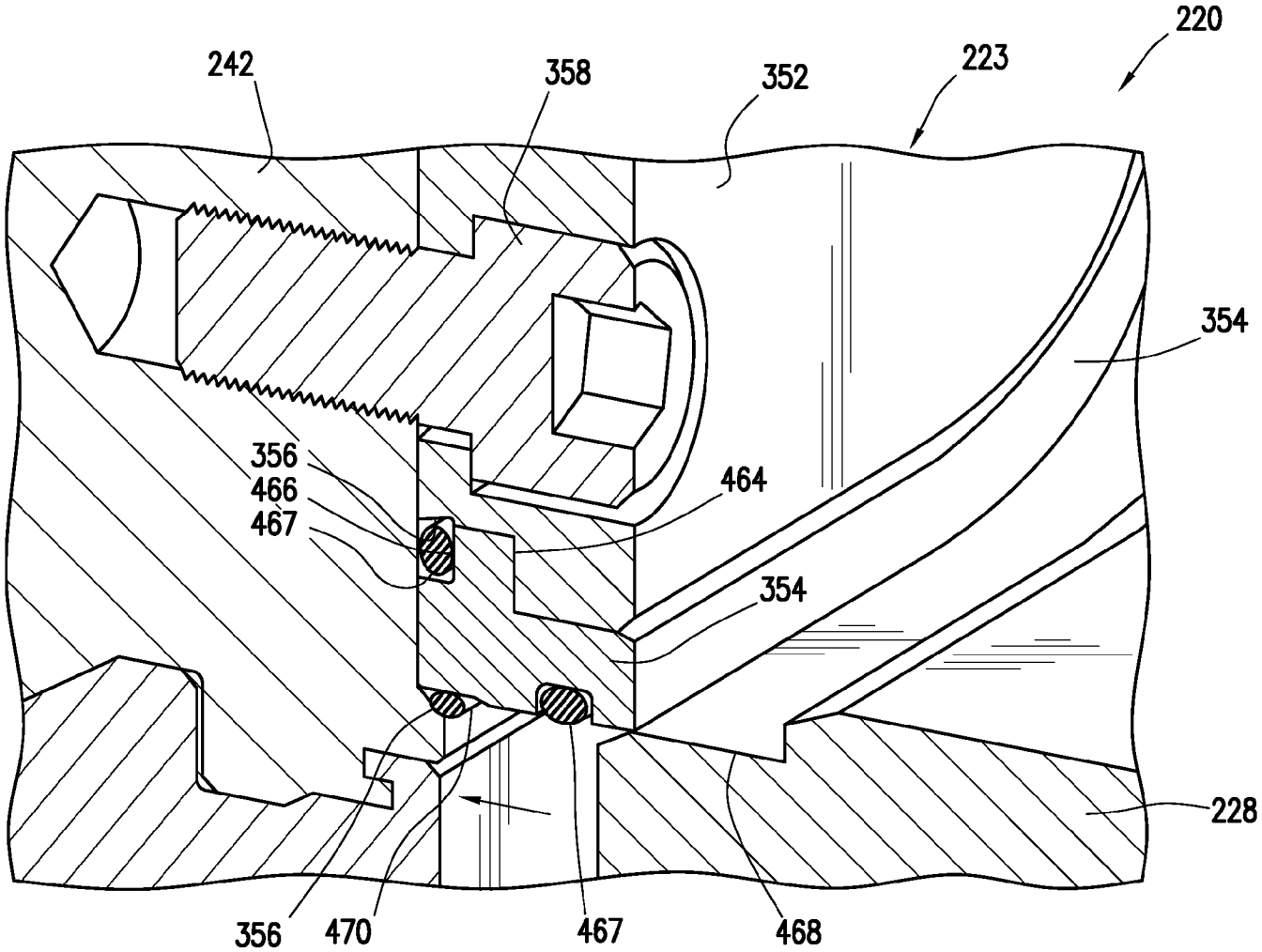
FIGS. 4A-4B depict perspective, cross-sectional views of a portion of a BOP depicting a seal assembly therein in a sealed and an unsealed position, respectively.
Figure 4B:
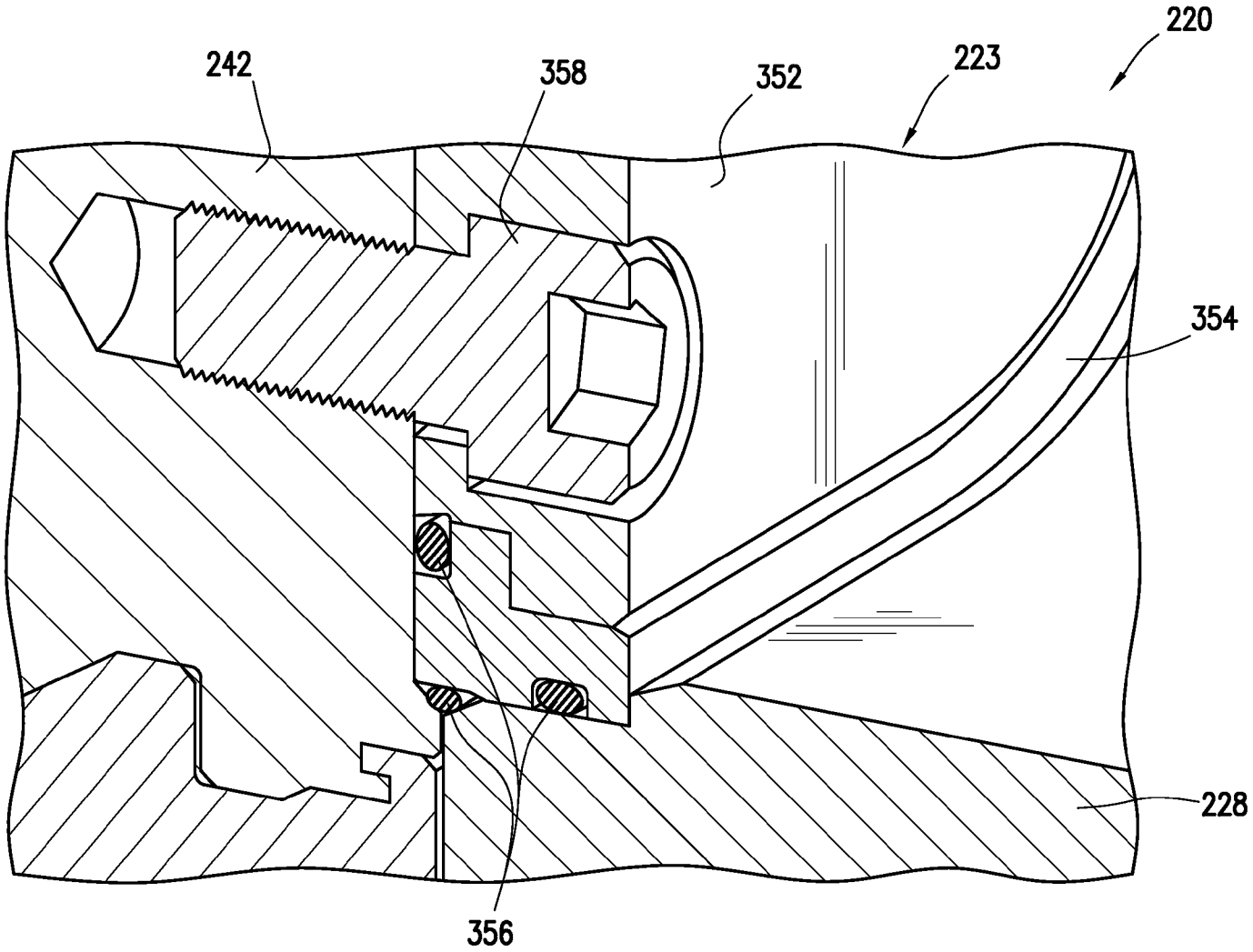

FIGS. 4A and 4B depict perspective, cross-sectional views of a portion of the BOP 220 of FIGS. 2A and 2B depicting the seal assembly 223 in a pre-aligned (or mis-aligned or unsealed) and aligned (or sealed) position, respectively. As shown in these figures, the locking plate 352 has a seal groove 464 for receiving a carrier lip 466 of the seal carrier 354 and a seal 356. The seal carrier has pockets 467 for receiving the seals 356. The seal carrier 354 rests against the interior surface of the door 242. A bottom surface 470 of the seal carrier 354 rests against the housing 228. Seals 356 are positioned adjacent the bottom surface 470 of the seal carrier 354 to provide support thereto. The housing 228 is provided with a housing groove 468 for receiving the seal carrier 354.

The seal carrier 354 may have a cross-sectional shape configured to fit between the door 242, plate 352 and/or housing 228. The door 242, plate 352 and/or housing 228 may be provided with various grooves for receiving the seal carrier 354. The seal carrier 354 may be provided with a desired shape and various extensions or lips for fitting into the various grooves. One or more seals 356 may be provided in various positions about the seal carrier 354. The seal carrier 354 and/or seals 356 may be of an elastomeric, metal of other material of various strengths capable of providing sealing between components of the BOP. In an example, the seal carrier 354 is metal and the seals 356 are elastomeric material positionable in sealing engagement with the housing 228 and/or the door 242.

In the pre-aligned position of FIG. 4A, bolts 358 may be positioned through the seal plate 352 and into the door 242 as the seal assembly 223 is being installed. Once in the pre-alignment position, the bolts 358 may be adjusted (e.g., untightened) to move the seal assembly 223 to the aligned position as shown in FIG. 4B. Once in the aligned position, the bolts 358 may be tightened and the seal assembly 223 secured in position for sealing with the door assembly 242 and housing 228. In some cases, the door assembly 225 may not be aligned in the BOP 220. The seal assembly 223 may be aligned to the housing 228 of the BOP 220 and adjusted for misalignments that may occur in the door assembly 225, thereby providing an alignable seal assembly 223.

FIGS. 5A-5D depict longitudinal cross-sectional views of a portion of a BOP with a seal assembly 223 having various configurations. In each version, the BOP has a door 242 and a housing 228 with a seal assembly 223, 223*a-c* receivably positioned therebetween. The door 242 and housing 228 may be modified to receive the various seal assemblies, and the various seal assemblies may be modified for sealable installation between the door 242 and housing 228.

FIG. 5A shows the seal assembly 223 of FIGS. 4A and 4B. FIG. 5B shows a seal assembly 223*a*. In this version, the seal carrier 354*a* has a seal lip 466*a* extending a distance into a groove 572 of the door 242*a*. A first portion of the bottom surface 470*a* of the seal 466*a* rests in the groove 572 in the door 242*a* and a portion of the bottom surface 470*a* of the seal 466*a* rests in a cavity 468*a* in the housing 228*a*. Seals (or other energizing members) 356 are positioned along the bottom surface 470*a* of the seal 466*a*. The seal 466*a* also has a shoulder 574 for receiving a portion of the seal plate 352*a*.

In the version of FIG. 5C, the seal assembly 223*b* includes a seal plate 352*b* with a double groove 464*b* for receiving lips 466*b* of seal carrier 354*b*. Seals (or other energizing members) 356*b* are positioned along a door surface 571 and a bottom surface 370*b* of the seal carrier 354*b*. The bottom surface 370*b* is stepped for contact with a cavity 468*b* the housing 228*b* and a door groove 572*b*.

In the version of FIG. 5D, the housing 228*c* has an inclined groove or surface 468*c* to receive the seal carrier 354*c* and seals 356*c* of the seal assembly 223*c*. The bottom surface 370*c* of the seal carrier 354*c* is inclined for matingly engaging the inclined groove 468*c*. The door 242*c* has a stepped door groove 572*c* along an interior surface thereof for receiving lips 466*c*. Seals 356*c* are positioned between the seal carrier 354*c* and the housing 228*c* and the door 242*c*.

While various configurations of the door assembly, seal assembly and housing are provided, it will be appreciated that portions of the BOPs and seal assemblies herein may be configured to enhance sealing therebetween.

It will be appreciated by those skilled in the art that the techniques disclosed herein can be implemented for automated/autonomous applications via software configured with algorithms to perform the desired functions. These aspects can be implemented by programming one or more suitable general-purpose computers having appropriate hardware. The programming may be accomplished through the use of one or more program storage devices readable by the processor(s) and encoding one or more programs of instructions executable by the computer for performing the operations described herein. The program storage device may take the form of, e.g., one or more floppy disks; a CD ROM or other optical disk; a read-only memory chip (ROM); and other forms of the kind well known in the art or subsequently developed. The program of instructions may be "object code," i.e., in binary form that is executable more-or-less directly by the computer; in "source code" that requires compilation or interpretation before execution; or in some intermediate form such as partially compiled code. The precise forms of the program storage device and of the encoding of instructions are immaterial here. Aspects of the disclosure may also be configured to perform the described functions (via appropriate hardware/software) solely on site and/or remotely controlled via an extended communication (e.g., wireless, internet, satellite, etc.) network.

While the embodiments are described with reference to various implementations and exploitations, it will be understood that these embodiments are illustrative and that the scope of the inventive subject matter is not limited to them. Many variations, modifications, additions and improvements are possible. For example, one or more seal assemblies may be provided with various shapes and positioned between various components of the BOP to provide sealing therebetween.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A seal assembly for a blowout preventer of a wellsite, the blowout preventer comprising a housing and a door having a surface positionable against the housing, the housing having a bore and a channel therethrough, a tubular positionable through the bore and engageable therein, the seal assembly comprising:

a seal plate positionable against the surface of the door and the housing of the blowout preventer, the seal plate having at least one seal groove extending into a perimeter of the seal plate;

a seal carrier having an inner surface disposable about the perimeter of the seal plate, the seal carrier having at least one carrier lip extending from the inner surface, the at least one carrier lip receivable in the at least one seal groove, the seal carrier having at least one seal receptacle extending into a surface of the seal carrier; and at least one seal receivably positionable in the at least one seal receptacle and self-alignable therein, the at least one seal positionable in sealing engagement with at least one of the housing and the door whereby a seal is formed therebetween.

2. The seal assembly of claim 1, wherein the door is operatively connectable to the housing and providing selective access to the channel.

3. The seal assembly of claim 1, wherein the seal plate has an elliptical body with flat surfaces positionable adjacent the housing and the door.

4. The seal assembly of claim 1, wherein the seal plate has at least one hole therethrough to receive at least one portion of a ram shaft therethrough.

5. The seal assembly of claim 1, further comprising fasteners to operatively connect the seal plate to the door, the housing and combinations thereof.

6. The seal assembly of claim 1, wherein the seal plate has at least one step along a portion of the perimeter thereof, the seal carrier having the at least one carrier lip receivable in the at least one step and adjacent the one of the housing, the door, and combinations thereof.

7. The seal assembly of claim 1, wherein at least one of the housing and the door has at least one housing receptacle, the seal carrier having another of the at least one carrier lips receivable in the at least one housing receptacle.

8. The seal assembly of claim 1, wherein the seal carrier and the at least one seal comprise one of a rubber material, a metal material and combinations thereof.

9. The seal assembly of claim 1, wherein the seal plate comprises a metal material.

10. The seal assembly of claim 1, wherein the receptacle extends into a periphery of the seal carrier.

11. The seal assembly of claim 1, wherein the inner surface is positionable adjacent the door.

12. The seal assembly of claim 1, wherein the receptacle extends into a corner of the seal carrier between the inner surface and a periphery of the door.

13. The seal assembly of claim 1, wherein the seal carrier has a housing lip receivable in a housing groove of the housing.

14. The seal assembly of claim 1, wherein the at least one seal abuts the door, the housing and the seal carrier.

15. The seal assembly of claim 1, wherein the at least one seal abuts the door, the seal plate, and the seal carrier.

16. A blowout preventer for a wellsite having a tubular extending into a wellbore, comprising a housing having a bore and a channel therethrough, the tubular positionable through the bore and engageable therein;

a door having a surface positionable against the housing; and at least one seal assembly, comprising:

a seal plate positionable against the surface of the door and the housing of the blowout preventer, the seal plate having at least one seal groove extending into a perimeter of the seal plate;

a seal carrier having an inner surface disposable about the perimeter of the seal plate, the seal carrier having at least one carrier lip extending from the inner surface, the at least one carrier lip receivable in the at least one seal groove, the seal carrier having at least one seal receptacle extending into a surface of the seal carrier; and at least one seal receivably positionable in the at least one seal receptacle, the at least one seal positionable in sealing engagement with at least one of the housing and the door whereby a seal is formed therebetween.

17. The blowout preventer of claim 16, wherein the provides selective access to the channel.

18. The blowout preventer of claim 17, wherein the seal plate is operatively connectable between the housing and the door, and the at least one seal is positionable in sealing engagement with the housing and the door.

19. The blowout preventer of claim 16, wherein the door comprises a ram assembly slidably positionable in the channel to sever the tubular.

20. The blowout preventer of claim 19, further comprising an actuator operatively connectable to the ram assembly for actuation thereof.

21. The blowout preventer of claim 19, wherein the door comprises a door assembly operatively connectable to the housing and providing selective access to the channel, the door assembly receiveably connectable to the ram assembly.

22. The blowout preventer of claim 19, wherein at least one hole of the seal plate receives a portion of the ram assembly therethrough.

23. The blowout preventer of claim 16, wherein the housing has a housing receptacle shaped to receive the seal carrier.

24. The blowout preventer of claim 16, wherein the door has a door receptacle shaped to receive the at least one seal assembly.

25. A method of sealing a blowout preventer of a wellsite, the blowout preventer comprising a housing and a door having a surface positionable against the housing, the housing having a bore and a channel therethrough, a tubular positionable through the bore and engageable therein, the method comprising:

operatively connecting a seal plate against the surface of the door and the housing of the blowout preventer, the seal plate having at least one seal groove extending into a perimeter of the seal plate;

disposing an inner surface of a seal carrier about the perimeter of the seal plate, the seal carrier having at least one carrier lip extending from the inner surface and receivable in the at least one seal groove, the seal carrier having at least one seal receptacle extending into a surface of the seal carrier; and forming a seal between the housing and the door by receivably positioning at least one seal in at least one seal receptacle and in sealing engagement with at least one of the housing and the door.

* * * * *